US010008120B2

(12) United States Patent
Nordbruch

(10) Patent No.: US 10,008,120 B2
(45) Date of Patent: Jun. 26, 2018

(54) METHOD AND SYSTEM FOR MONITORING A VEHICLE IN A PARKING FACILITY

(71) Applicant: Robert Bosch GmbH, Stuttgart (DE)

(72) Inventor: Stefan Nordbruch, Kornwestheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days. days.

(21) Appl. No.: 15/516,945

(22) PCT Filed: Sep. 29, 2015

(86) PCT No.: PCT/EP2015/072328
§ 371 (c)(1),
(2) Date: Apr. 5, 2017

(87) PCT Pub. No.: WO2016/066352
PCT Pub. Date: May 6, 2016

(65) Prior Publication Data

US 2017/0309184 A1 Oct. 26, 2017

(30) Foreign Application Priority Data

Oct. 27, 2014 (DE) ..... 10 2014 221 745

(51) Int. Cl.
*G08G 1/123* (2006.01)
*G08G 1/00* (2006.01)
*G08G 1/14* (2006.01)

(52) U.S. Cl.
CPC ..... *G08G 1/20* (2013.01); *G08G 1/146* (2013.01)

(58) Field of Classification Search
CPC ..... G08G 1/146; G01G 1/148; G01G 1/168
USPC ..... 340/937, 993
See application file for complete search history.

(56) References Cited

U.S. PATENT DOCUMENTS

| | | | |
|---|---|---|---|
| 6,340,935 | B1 | 1/2002 | Hall |
| 2002/0014811 | A1 | 2/2002 | Tamai et al. |
| 2002/0140811 | A1 | 10/2002 | Schuette |
| 2003/0069665 | A1 | 4/2003 | Haag |
| 2006/0007309 | A1 | 1/2006 | Machinist et al. |

(Continued)

FOREIGN PATENT DOCUMENTS

| | | | |
|---|---|---|---|
| DE | 102007034154 | A1 | 1/2009 |
| DE | 102008019346 | A1 | 9/2009 |

(Continued)

OTHER PUBLICATIONS

International Search Report dated Feb. 15, 2016, of the corresponding International Application PCT/EP2015/072328 filed Sep. 29, 2015.

*Primary Examiner* — Kevin Kim
(74) *Attorney, Agent, or Firm* — Norton Rose Fulbright US LLP; Gerard Messina

(57) ABSTRACT

A method for monitoring a vehicle in a parking facility, the vehicle being transferred by its driver to a parking facility operator in a transfer zone, and subsequently being parked a parking space and, after unparking, being transferred to the driver again in a pick-up zone, the vehicle being at least visually monitored during the entire stay in the parking facility with the aid of a monitoring infrastructure assigned to the parking facility, the data being recorded, and the data being provided to the driver. A computer program and a system, which are configured to carry out the method, are also described.

10 Claims, 2 Drawing Sheets

(56) References Cited

U.S. PATENT DOCUMENTS

| | | | | |
|---|---|---|---|---|
| 2008/0258935 | A1 | 10/2008 | Lee | |
| 2015/0033647 | A1* | 2/2015 | Suhami | E04H 6/10 52/236.3 |
| 2015/0138001 | A1* | 5/2015 | Davies | G08G 1/149 340/932.2 |
| 2015/0286219 | A1* | 10/2015 | Reichel | G08G 1/0965 701/23 |

FOREIGN PATENT DOCUMENTS

| | | | |
|---|---|---|---|
| DE | 102012017497 | B3 | 12/2013 |
| DE | 102012015968 | A1 | 3/2014 |
| DE | 102012222562 | A1 | 6/2014 |

* cited by examiner

METHOD AND SYSTEM FOR MONITORING A VEHICLE IN A PARKING FACILITY

FIELD

The present invention relates to a method for monitoring a vehicle in a parking facility, the vehicle being transferred by its driver to a parking facility operator in a transfer zone. Further aspects of the present invention relate to a computer program for carrying out the method and to a system for monitoring a vehicle in a parking facility.

BACKGROUND INFORMATION

To facilitate the parking of a motor vehicle, in some conventional services, the driver drops off his/her vehicle in a transfer zone and transfers it to a parking facility operator. The parking facility operator then ensures that the vehicle is parked in a free parking space and later, at the request of the driver, is provided again for pick-up.

A corresponding service, which is also referred to as valet parking, is offered by good hotels and restaurants, for example, and in connection with attended parking facilities. In general, the driver transfers his/her vehicle to a parking facility employee who thereupon drives the vehicle to a free parking space and later also provides the vehicle again at a pick-up location.

In the related art, vehicles are equipped with autonomous or semi-autonomous parking assistance systems. It is possible to grant the parking facility operator access to the autonomous parking assistance systems from outside the vehicle, so that the vehicle moves independently in the parking facility and is autonomously parked in a free parking space.

In all cases, the problem that arises is that accidents may occur during the operation of motor vehicles, during which a vehicle is damaged. It is of interest for the operator of a parking facility to be able to check whether damage to a vehicle occurred during the stay at the parking facility or was already present before.

A traffic facility including a driving area which is autonomously negotiable by a vehicle is described in German Patent Application No. DE 10 2012 017 497 B3. It is provided that the vehicle is detected with the aid of a camera or another sensor system before the vehicle enters the driving area, and that a model of the vehicle skin is created. The data may be forwarded to the driver via a communication unit on a mobile terminal, for example a smart phone, so that the driver is informed about the condition of his/her vehicle.

A method for autonomously parking a vehicle in a parking area is described in German Patent Application No. DE 10 2012 015 968 A1. The vehicles are controlled and monitored by an external control unit. Sensors of the controlled vehicle are used to detect an impending collision or a collision which has already taken place, a decision being made as a function of the situation. When an impending collision is detected, measures for avoiding the collision are taken. If a collision has already taken place, measures for documentation and information are initiated.

A disadvantage of the monitoring methods in the related art is that these are only able to supply a snapshot of the condition of the vehicle.

SUMMARY

A method is provided for monitoring a vehicle in a parking facility, the vehicle being transferred by its driver to a parking facility operator in a transfer zone and subsequently being parked in a parking space and, after unparking, being transferred back to the driver in a pick-up zone. It is furthermore provided that the vehicle is at least visually monitored during the entire stay in the parking facility with the aid of a monitoring infrastructure assigned to the parking facility, the data are recorded, and the data are made available to the driver.

The parking facility may be an open parking area, a parking garage or an underground parking garage, the parking facility including a plurality of parking spaces. The parking facility may furthermore be designed as a block of garages including a plurality of individual garages, an individual garage representing a parking space of the parking facility. The parking facility moreover includes a transfer zone in which a vehicle may be transferred into the care of the parking facility operator, and a pick-up zone in which the vehicles are later provided again for pick-up by their driver.

In the first step of the method, the driver drives his/her vehicle to the transfer zone and leaves his/her vehicle. Thereafter, the vehicle is transferred to the care of the parking facility operator. Depending on the specific embodiment, for example, the vehicle key is transferred to an employee for this purpose, who accepts the vehicle and drives it to a parking space. If, in contrast, the vehicle is configured to drive autonomously, i.e., the vehicle is able to independently carry out both a transverse guidance (steering) and a longitudinal guidance (acceleration and braking), alternatively it is also possible to grant access to a parking assistance system assigned to the vehicle. The parking facility operator then transmits pieces of information to corresponding systems in the vehicle. These pieces of information, in a first step, may in particular include an indication that autonomous parking is being offered and, in further steps, these pieces of information may contain instructions, for example, with the aid of which the vehicle is guided to a free parking space.

Furthermore, it is possible that the vehicle is loaded onto a carrier in the transfer zone, and subsequently is moved to a parking space with the aid of the carrier.

When the vehicle is needed by the driver again, it is unparked from the parking space and guided to the pick-up zone. Analogously to parking in the parking space, this process takes place either autonomously by the vehicle itself, via a carrier, or with the aid of an employee of the parking facility operator.

In all embodiment variants, it is provided that the vehicle is at least visually monitored during the entire stay in the parking facility. For this purpose, the parking facility includes a monitoring infrastructure, which may include, for example, a plurality of cameras and/or sensors, in particular video cameras. In addition, further sensors may be used; for example, it is possible to scan the vehicle using laser beams to create a three-dimensional model of the vehicle. Further sensors may be used to identify collisions. In particular, microphones are suitable for this purpose, which may identify noise typical of a collision, such as a bang. It is also possible to situate photoelectric barriers a short distance in front of walls, an interruption in the photoelectric barrier indicating a collision with the wall. The monitoring structure is situated distributed across the entire parking facility in such a way that the vehicle is constantly at least in the field of view of one sensor starting at the transfer zone. The data detected by the sensors, in particular visual data detected by cameras, are recorded and provided to the driver. This allows the driver to continuously assure himself/herself that his/her vehicle is undamaged.

Due to the continuous monitoring of the vehicle with the aid of the monitoring infrastructure assigned to the parking facility, data are available about the path of the vehicle from the transfer zone to the parking space, about the path from the parking space to the pick-up zone, and for the entire stay in the parking space. It is provided that the data detected by the monitoring infrastructure are assigned to the vehicle to be monitored.

For carrying out this assignment, it is possible to track the vehicle in the visual files or in the images with the aid of object identification methods. Furthermore, it would also be possible to use clear identification features for the assignment, for example the license plate of the vehicle. For this purpose, the license plate may be identified and read out in the visual data via appropriate identification algorithms, whereby the visual data are linked to the license plate, and thus to the vehicle. The detected data may also be linked to further data, such as a reservation number or the name of the driver.

In one specific embodiment of the method, it is provided that live access to the data is provided to the driver. In this way, it is possible for the driver to establish with no time delay whether there is damage to his/her car, and also to directly track the process of his/her car being parked or unparked.

Preferably, it is possible to immediately inform the driver when the sensors have established a collision or damage to the vehicle. This may take place, for example, by sending a message to a mobile device, in particular to a smart phone.

For accessing the data, the driver may be provided by the parking facility operator with appropriate means, for example screens or terminals situated in the area of the transfer zone or the pick-up zone. In one specific embodiment, it is furthermore possible that the data are provided via a data network, in particular via the Internet. This allows the driver to also assure himself/herself of the condition of his/her vehicle from other locations.

In one specific embodiment, it is provided that the data are provided in such a way that these are retrievable via a mobile device, in particular via a smart phone or a tablet. An interface may be provided in the method for this purpose, via which an application running on the mobile device or an app downloaded onto a smart phone is able to access the provided data. It is also possible to provide a website for the access, which is able to adapt to the requirements of the terminal. It is possible, for example, that data are provided in a higher quality in the case of a retrieval via a stationary computer which has a particularly fast Internet connection than when the retrieval takes place via a smart phone.

It may furthermore be provided in the method that the data are deleted after a predefined storage duration and/or after a confirmation by the driver. The data are preferably kept available until the driver has been able to assure himself/herself that his/her vehicle is undamaged, and the parking facility operator thus has furnished proof that no damage occurred during the stay of the vehicle in the parking facility. Once it has been confirmed by the driver in a binding manner that his/her vehicle is undamaged, there is no further need to store the data, so that these may be deleted. It is also possible to predefine a maximum storage duration, for example established for a time period after which the statute of limitations for potential claims has lapsed, so that old data which are no longer required are also deleted.

The deletion clears memory space, which is now available again for further recordings, and it is also useful for data privacy reasons not to store the recorded data any longer than necessary.

According to the present invention, a computer program is furthermore provided, according to which one of the methods described herein is carried out when the computer program is being executed on a programmable computer device. The computer program may be, for example, a module for implementing the monitoring of a vehicle and/or an application for accessing the provided visual data, which is executable on a smart phone. The computer program may be stored on a machine-readable memory medium, such as on a permanent or rewritable memory medium, or in assignment to a computer device, or on a removable CD-ROM, DVD, Blu-Ray disk or a USB stick. In addition or as an alternative, the computer program may be provided for download on a computer device such as on a server, for example via a data network such as the Internet, or a communication link such as a telephone line or a wireless connection.

A further aspect of the present invention is the provision of a system for monitoring a vehicle in a parking facility. The system includes a transfer zone, a pick-up zone, and a plurality of parking spaces for this purpose. Furthermore, it is provided that the system includes a memory unit and a plurality of sensors, in particular cameras, which are configured to at least visually monitor the vehicle during the entire stay in the parking facility, the system being configured to record the data and to provide the data to the driver. The system is preferably configured to carry out one of the described methods, so that features described within the scope of the method apply correspondingly to the system and, vice versa, features described within the scope of the system apply correspondingly to the method.

With the aid of the provided method, seamless documentation of the stay of a vehicle in a parking facility is possible. This provides security to the parking facility operator, who is thus able to prove at any time whether or which damage occurred to the vehicle during the stay in the parking facility. The parking facility may in particular be designed as an open parking area or also as a parking garage, an underground parking garage, or as a block of garages.

The driver also benefits from the described method since he/she is able to assure himself/herself at any time of the condition of his/her vehicle. It is in particular possible to receive live access to the data, so that the driver not only receives a snapshot, but is informed about the instantaneous condition of his/her vehicle.

In advantageous specific embodiments, the driver is given the option of accessing the stored data online at any time, for example via a smart phone, and to track the process of parking or unparking live via the live access to the data.

After transferring the vehicle, the driver furthermore has the option of confirming the undamaged transfer of the vehicle to him/her, whereupon the recorded data may be promptly deleted. In this way, protection of data privacy may be complied with.

BRIEF DESCRIPTION OF THE DRAWINGS

Exemplary embodiments of the present invention are shown in the figures and are described in greater detail in the following description.

DETAILED DESCRIPTION OF EXAMPLE EMBODIMENTS

The figures only schematically represent the subject matter.

Figure 1:
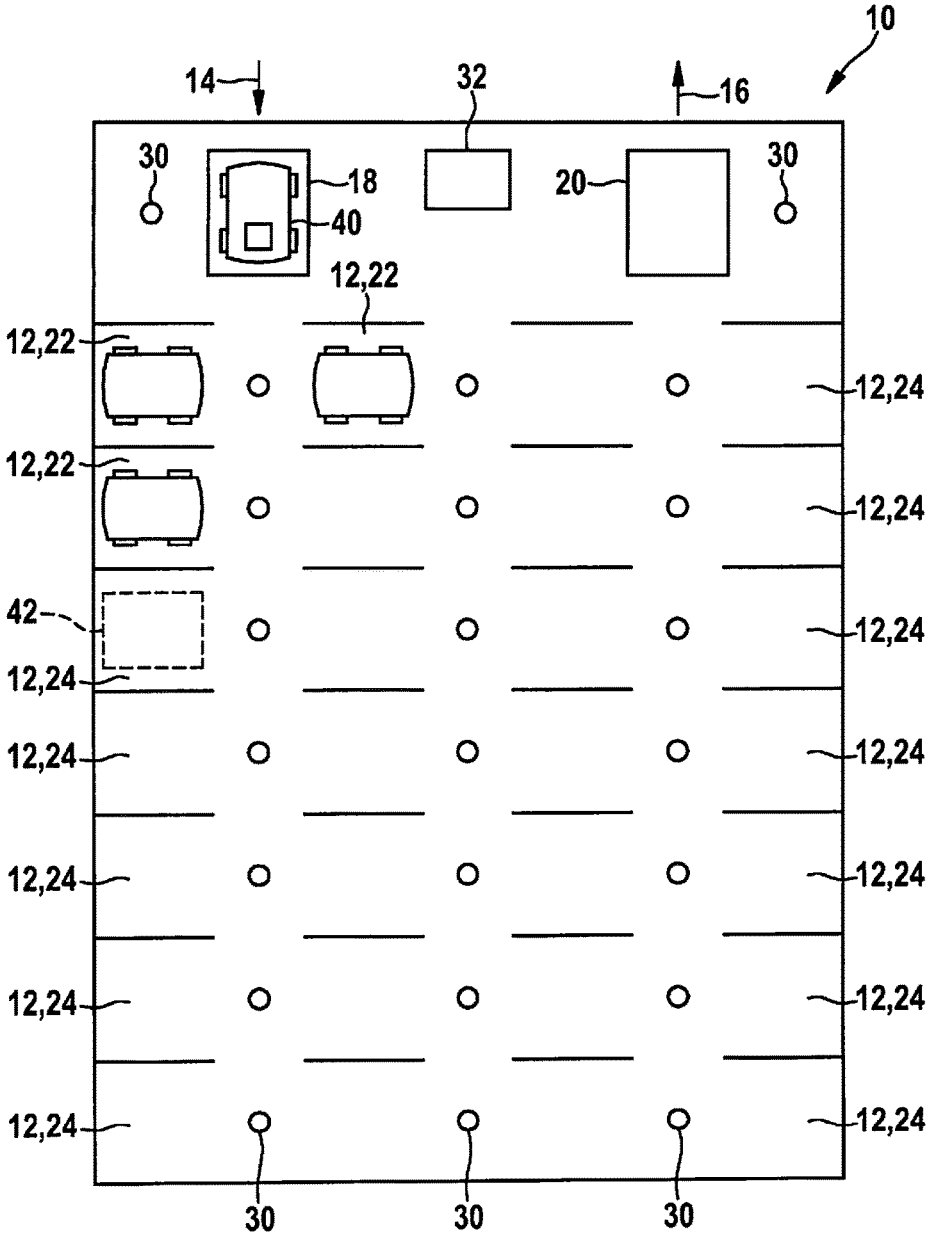
FIG. 1 shows a schematic illustration of a parking facility including an assigned monitoring infrastructure.

FIG. 1 shows a schematic illustration of a parking facility including an assigned monitoring infrastructure.

In FIG. 1, a parking facility 10 including a plurality of parking spaces 12 is shown in a schematic top view. The schematic illustration shows a parking facility 10 as an open area, it also being possible to apply the method according to the present invention to parking garages, blocks of garages and underground parking garages.

Parking facility 10 includes an entrance 14, via which the vehicles may reach the parking facility, and an exit 16, via which the vehicles may leave parking facility 10. A transfer zone 18, in which a vehicle 40 may be transferred to the operator of parking facility 10, is situated in the vicinity of entrance 14. For this purpose, the driver of vehicle 40 drives his/her vehicle 40 to transfer zone 18, leaves his/her vehicle 40, and transfers his/her vehicle 40 to the operator of parking facility 10.

A monitoring infrastructure, which includes a plurality of cameras 30 and a memory unit 32, is assigned to parking facility 10 for monitoring vehicle 40 during the stay in parking facility 10. Cameras 30 are situated distributed in parking facility 10 in such a way that vehicle 40 is always in the field of view of at least one camera 30. In this way it is ensured that vehicle 40 is constantly visually monitored.

After vehicle 40 has been transferred to the parking facility operator, vehicle 40 is assigned a free parking space 24 out of the possible free parking spaces 24 as parking position 42. Already occupied parking spaces 12 are denoted by reference numeral 22 in FIG. 1.

After having been assigned parking position 42, vehicle 40 is moved to free parking space 24 selected as assigned parking position 42. If vehicle 40 is configured to carry out a drive maneuver autonomously with the aid of a parking assistance system, the operator of parking facility 10 may be granted access to the parking assistance system, so that vehicle 40 may autonomously move in the parking facility 10 and independently navigates to parking position 42. As vehicle 40 is driving to parking position 42, vehicle 40 is constantly in the field of view of at least one camera 30. Also after parking position 42 has been reached, i.e., in the parked state of vehicle 40, vehicle 40 is in the field of view of at least one camera 30.

If the driver intends to pick up his/her vehicle 40 again, the request of the driver is transmitted to the parking assistance system of vehicle 40. The transmitted pieces of information may include the position of pick-up zone 20, for example, whereupon the vehicle independently navigates to pick-up zone 20. Vehicle 40 is also constantly in the field of view of at least one camera 30 on the path from parking position 42 to pick-up zone 20.

The data recorded by cameras 30 are transmitted to memory unit 32. Depending on the embodiment variant, this may take place via cable connections or also wirelessly. In memory unit 32, an assignment of the recorded data to vehicle 40 is carried out. Furthermore, memory unit 32 is designed in such a way that it grants the driver of vehicle 40 access to the stored data. Such access may take place, for example, via computer devices assigned to parking facility 10, for example a screen situated in the area of transfer zone 18 or pick-up zone 20, or with the aid of a terminal situated there. Furthermore, it may be provided that the data are provided via a smart phone app or via an Internet service provider.

When vehicle 40 has reached pick-up zone 20, the driver of vehicle 40 may confirm the proper transfer and the damage-free condition of vehicle 40. Memory unit 32 thereupon deletes the recorded data which were assigned to vehicle 40.

Figure 2:
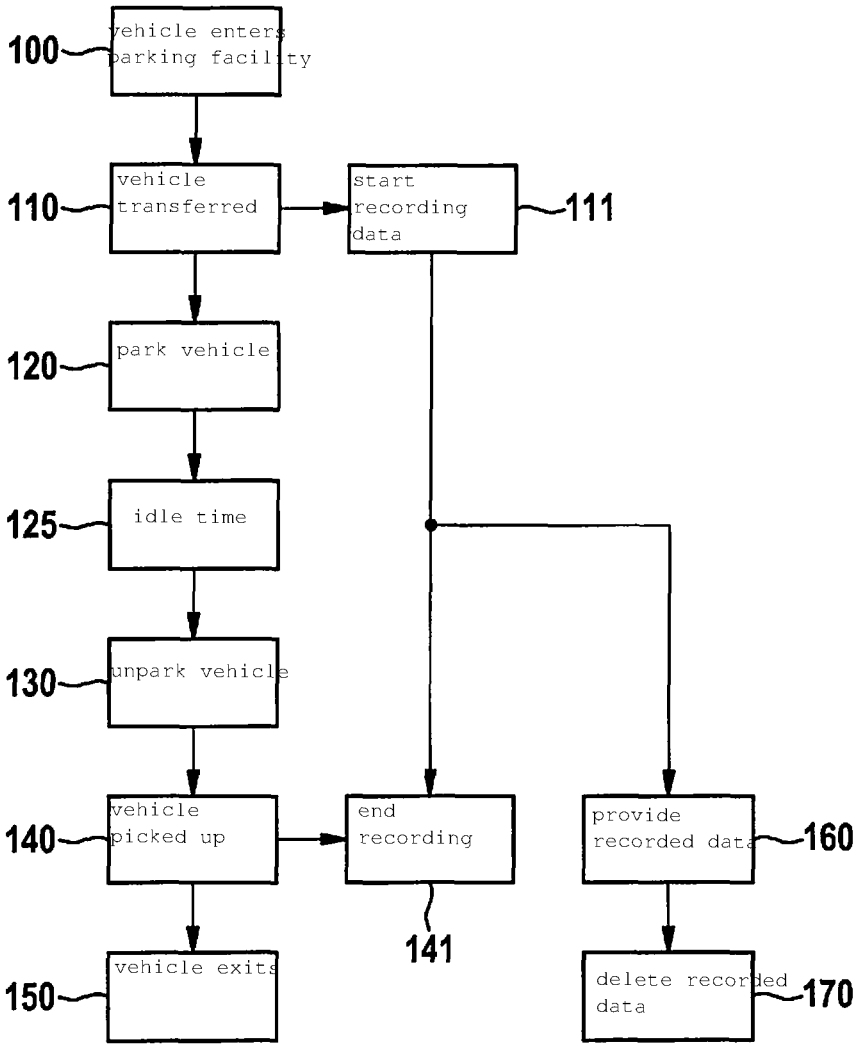
FIG. 2 shows a flow chart of one specific embodiment of the method according to the present invention.

FIG. 2 shows a flow chart for one specific embodiment of the method according to the present invention.

The method begins with a vehicle 40 entering 100 parking facility 10. In subsequent step 110, vehicle 40 is transferred by the driver to the operator of parking facility 10 in transfer zone 18. Thereupon, the start 111 of the recording data which are assigned to vehicle 40 and the parking 120 of vehicle 40 take place. After the vehicle has been parked in the parking space, an idle time 125 takes place during which vehicle 40 remains in assigned parking position 42.

As soon as vehicle 40 is needed again, for example in that the driver comes to pick-up zone 20, or also when a retrieval time predefined by the driver has been reached, vehicle 40 is unparked 130. Vehicle 40 is unparked and transferred to pick-up zone 20. In pick-up zone 20, vehicle 40 is picked up 140 by the driver. As a result, the recording of the data ends 141, and vehicle 40 exits 150.

In parallel thereto, the data are provided 160 beginning with the start 111 of the recording. These data include all recorded data which are assigned to vehicle 40. These data include visual data and possibly data from further sensors. Furthermore, the data may include live images of vehicle 40, if vehicle 40 is still located in the area of parking facility 10.

Following confirmation by the driver and/or after reaching a maximum predefined storage duration, the recorded data are deleted 170.

The present invention is not limited to the exemplary embodiments described here and the aspects highlighted therein. Rather, a plurality of modifications is possible, which are within the capabilities of those skilled in the art.

What is claimed is:

1. A method for monitoring a vehicle in a parking facility, the vehicle being transferred by a driver of the vehicle, to a parking facility operator in a transfer zone, and subsequently being parked in a parking space, and, after unparking, being transferred to the driver again in a pick-up zone, the method comprising:

at least visually monitoring the vehicle during the entire stay in the parking facility with the aid of a monitoring infrastructure assigned to the parking facility;

recording data based on the visual monitoring; and providing the recorded data to the driver;

wherein the data include a path of the vehicle from the transfer zone to the parking space, a path of the vehicle from the parking space to the pick-up zone, and a stay of the vehicle in the parking space, an assignment of the data to the vehicle taking place.

2. The method as recited in claim 1, wherein the vehicle is configured to drive autonomously, and the vehicle, when parking in a parking space, independently navigates to a parking space with the aid of pieces of information provided by an infrastructure of the parking facility and, when unparking, drives independently from the parking space to the pick-up zone.

3. The method as recited in claim 1, wherein the parking and the unparking of the vehicle is carried out either by human staff or by loading the vehicle onto a carrier and subsequently moving the carrier.

4. The method as recited in claim 1, wherein the driver is provided with live access to the data.

5. The method as recited in claim 1, wherein the data are provided via a data network.

6. The method as recited in claim 1, wherein the data are provided via the Internet.

7. The method as recited in claim 1, wherein the data are provided in such a way that these are retrievable via at least one of: i) a terminal provided in the parking facility, ii) a PC, iii) a mobile device, and vi) a smart phone.

8. The method as recited in claim 1, wherein the data are deleted after at least one of: i) a predefined storage duration, and ii) a confirmation by the driver.

9. A non-transitory computer-readable storage medium on which is stored a computer program for monitoring a vehicle in a parking facility, the vehicle being transferred by a driver of the vehicle, to a parking facility operator in a transfer zone, and subsequently being parked in a parking space, and, after unparking, being transferred to the driver again in a pick-up zone, the computer program, when executed by a computer, causing the computer to perform:

at least visually monitoring the vehicle during the entire stay in the parking facility with the aid of a monitoring infrastructure assigned to the parking facility;

recording data based on the visual monitoring; and providing the recorded data to the driver;

wherein the data include a path of the vehicle from the transfer zone to the parking space, a path of the vehicle from the parking space to the pick-up zone, and a stay of the vehicle in the parking space, an assignment of the data to the vehicle taking place.

10. A system for monitoring a vehicle in a parking facility, the system comprising:

a transfer zone;

a pick-up zone;

a plurality of parking spaces;

a memory unit;

a plurality of cameras configured to at least visually monitor the vehicle during the entire stay in the parking facility, the system being configured to record, in the memory unit, data based on the visual monitoring, and to provide the data to the driver;

wherein the data include a path of the vehicle from the transfer zone to the parking space, a path of the vehicle from the parking space to the pick-up zone, and a stay of the vehicle in the parking space, an assignment of the data to the vehicle taking place.

* * * * *